US009016088B2

(12) United States Patent
Butts

(10) Patent No.: US 9,016,088 B2
(45) Date of Patent: Apr. 28, 2015

(54) SYSTEM AND METHOD FOR PRODUCING LNG FROM CONTAMINATED GAS STREAMS

(75) Inventor: Rayburn C. Butts, Midland, TX (US)

(73) Assignee: Butts Propertties, Ltd., Midland, TX (US)

( * ) Notice: Subject to any disclaimer, the term of this patent is extended or adjusted under 35 U.S.C. 154(b) by 1210 days.

(21) Appl. No.: 12/915,815

(22) Filed: Oct. 29, 2010

(65) Prior Publication Data

US 2012/0103010 A1 May 3, 2012

Related U.S. Application Data

(60) Provisional application No. 61/256,053, filed on Oct. 29, 2009.

(51) Int. Cl.
*F25J 3/00* (2006.01)
*F25J 3/02* (2006.01)

(52) U.S. Cl.
CPC ..... *F25J 3/0209* (2013.01); *F25J 2210/60* (2013.01); *F25J 3/0233* (2013.01); *F25J 3/0257* (2013.01); *F25J 2200/02* (2013.01); *F25J 2200/50* (2013.01); *F25J 2200/74* (2013.01); *F25J 2210/40* (2013.01); *F25J 2215/04* (2013.01); *F25J 2220/62* (2013.01); *F25J 2230/20* (2013.01); *F25J 2240/02* (2013.01); *F25J 2240/12* (2013.01); *F25J 2245/90* (2013.01); *F25J 2270/02* (2013.01); *F25J 2270/04* (2013.01); *F25J 2270/06* (2013.01); *F25J 2270/88* (2013.01); *F25J 2290/34* (2013.01); *F25J 2290/62* (2013.01); *Y10S 62/927* (2013.01)

(58) Field of Classification Search
CPC ... F25J 2200/50; F25J 2200/74; F25J 1/0022; F25J 3/0209; F25J 3/0233; F25J 3/0257; F25J 2215/04; F25J 2220/62; F25J 2220/66; F25J 2200/68; F25J 2245/02; F25J 2220/64; F25J 2270/02; F25J 2270/04; F25J 2270/06; F25J 2270/88
USPC ..... 62/611, 613, 618, 619, 633, 634
See application file for complete search history.

(56) References Cited

U.S. PATENT DOCUMENTS 5,141,544 A 8/1992 Butts
5,257,505 A 11/1993 Butts (Continued)

OTHER PUBLICATIONS

Ray Zahradnik, "Conversion of Coal Mine Methane to LNG for Heavy Vehicle Fuel"; Appalachian-Pacific Coal Mine Methane Power Company, LLC (slides 1-30).*

(Continued)

*Primary Examiner* — Frantz Jules
*Assistant Examiner* — Keith Raymond
(74) *Attorney, Agent, or Firm* — Ross Barnes LLP; Monty L. Ross; Robin L. Barnes

(57) ABSTRACT

A system and method for removing nitrogen and producing liquefied natural gas ("LNG") from methane without the need for external refrigeration. The invention also relates to a system and method for removing nitrogen from methane and for producing liquefied nitrogen in addition to LNG. The system and method of the invention are particularly suitable for use in recovering and processing comparatively small volumes of methane from coal mines or from flash gas captured at an LNG loading site.

8 Claims, 4 Drawing Sheets

(56) References Cited

U.S. PATENT DOCUMENTS

| | | | | | |
|---|---|---|---|---|---|
| 5,375,422 | A | | 12/1994 | Butts | |
| 5,617,741 | A | * | 4/1997 | McNeil et al. | 62/622 |
| 5,802,871 | A | * | 9/1998 | Howard et al. | 62/627 |
| 6,070,429 | A | * | 6/2000 | Low et al. | 62/612 |

OTHER PUBLICATIONS

Environmental Protection Agency, "Coal Mine Methane and LNG", EPA Coalbed Methane Outreach Program Technical Options Series, Nov. 2008.

* cited by examiner

SYSTEM AND METHOD FOR PRODUCING LNG FROM CONTAMINATED GAS STREAMS

CROSS-REFERENCE TO RELATED APPLICATION

This application claims the benefit of U.S. Provisional Application No. 61/256,053, filed Oct. 29, 2009.

BACKGROUND OF THE INVENTION

1. Field of the Invention

This invention relates to a system and method for removing nitrogen and producing liquefied natural gas ("LNG") from gaseous streams containing methane and other impurities without the need for an external refrigeration system. The invention also relates to a system and method for removing nitrogen from methane and for producing liquefied nitrogen in addition to LNG. The system and method of the invention are particularly suitable for use in recovering and processing comparatively small volumes of methane from coal mine vent streams or streams containing methane and nitrogen captured as flash gas at an LNG loading site.

2. Description of Related Art

Because many sources of methane produced during mining, energy transport or other industrial applications are not located near a natural gas transmission pipeline or other facility having gas-processing or liquefaction capabilities, a significant amount of methane gas, often combined with other gaseous or vaporous components, is either flared or vented to the atmosphere. This is particularly true in remote or otherwise underdeveloped areas where environmental impact is less of a concern than in the United States and other developed countries.

Naturally occurring methane is often encountered in coal mines, where it poses a significant risk to miners and to the mine subsurface equipment and inventory. This risk arises from miners being unable to breathe methane gas and also because air containing more than about 5 percent methane (preferably not more than about 2 percent) poses a significant risk of explosion. For these reasons, vertical shafts are frequently drilled into coal-containing formations ahead of the mining equipment so that any pockets of methane encountered during the drilling can be brought to the surface. Air is also forced down into subterranean mines and circulated through the mine shafts to dilute any residual methane that may be present and force it to the surface as well. Once the mining equipment reaches the vertical shafts drilled to recover methane from the formation, collapses can occur that produce another kind of methane-containing gas referred to as "gob gas," which is also extremely hazardous.

Also, at LNG loading facilities, some LNG is typically vaporized as flash gas when the product first enters the tank, which is typically in an LNG tanker or other transport vessel. Because LNG normally comprises a minor amount of residual nitrogen, and because the nitrogen vaporizes at a lower temperature than LNG, the flash gas thus produced will contain a higher percentage of nitrogen than is contained in the LNG. For this reason, even where the flash gas is captured without exposing it to air, the methane in the flash gas cannot readily be re-liquefied without first removing the nitrogen. Although the amount of methane in the flash gas is relatively minor compared to the total amount being loaded, it may not enough to justify economically the investment and expense required to remove the nitrogen and then re-liquefy the methane using conventional technology. Unfortunately, this can cause operators to resort to the more expedient but less environmentally responsible alternatives of venting or flaring the flash gas.

Advantages of recovering coal mine methane for producing LNG, the existing technologies and the importance of accommodating smaller gas flows than conventional natural gas to LNG applications are all discussed in "Coal Mine Methane and LNG," a paper published in November 2008 by the U.S. Environmental Protection Agency Coalbed Methane Outreach Program Technical Options Series.

Prior patents disclosing other gas processing technology invented by Rayburn C. Butts of BCCK Engineering include U.S. Pat. Nos. 5,141,544; 5,257,505; and 5,375,422.

Compander technology comprising an integrally geared design with one or more expansion stages and one or more compressor stages has previously been disclosed, for example, by Cryostar Industries. The expansion of gas allows for energy to be extracted or harnessed by the use of an expander device. The expander is coupled with a matching compressor, thereby creating a stage compression as is useful in the process. Auxiliary compression is often required to produce the total amount of compression requirements.

SUMMARY OF THE INVENTION

The system and method disclosed herein facilitate the economically efficient and environmentally friendly removal of nitrogen from methane and the production of LNG without the use of an external refrigeration system. As used throughout this specification and claims, the terms "external refrigeration" and "recirculated refrigerant" refer to cooling by means of a recirculated coolant that is external to the process streams emanating directly or indirectly from the inlet gas, and also include cascade refrigeration or mixed refrigerant processes as those conventional cascade and mixed refrigerant processes are known to and understood by those of ordinary skill in the art. According to one embodiment of the invention, nitrogen removed from the methane stream is also liquefied and produced in addition to LNG. The system and method of the invention are suitable for use in processing relatively small volumes of methane in comparison to conventional natural gas processing plants, and are particularly suitable for use in processing methane recovered from coal mines and from LNG loading facilities.

It has now been discovered that integration of some of the nitrogen removal technology previously disclosed, for example, in U.S. Pat. Nos. 5,375,422, 5,257,505 and 5,141,544 with additional technology as disclosed herein, offers significant advantages not previously achievable by those of ordinary skill in the art using existing technologies. These advantages include, for example, an ability to process and liquefy methane at relatively low temperatures through the use of strategically placed turbo expander or compander units without the need for an external refrigeration system, thereby substantially reducing horsepower and compressor requirements, with attendant reductions in capital investment and operating costs. Moreover, because the economic and operational advantages of the subject system and method can be realized in facilities processing comparatively small volumes of methane, the technology can be provided and practiced at locations where methane would otherwise be flared or vented to the atmosphere, thereby eliminating or significantly reducing any adverse environmental impact.

According to one embodiment of the invention, a system is disclosed for removing nitrogen and for producing LNG from methane gas comprising other gaseous components, the system comprising a source of methane gas disposed proximally to a processing site, the source being accessible to the site without transport through an external pipeline; and a nitrogen removal section configured to remove nitrogen gas from the methane gas and to liquefy a substantial portion of the methane gas to produce LNG without use of a recirculated refrigerant.

According to another embodiment of the invention, a system is disclosed for producing LNG from methane gas comprising other gaseous components, the system comprising a source of methane gas disposed proximally to a processing site, the source being accessible to the site without transport through an external pipeline; a first processing section configured to remove oxygen gas from the methane gas; a second processing section configured to remove carbon dioxide from the methane gas; a third processing section configured to dehydrate the methane gas; a fourth processing section configured to remove nitrogen gas from the methane gas and to liquefy a substantial portion of the methane gas to produce LNG without use of a recirculated refrigerant; an LNG subcooler section disposed downstream of the fourth processing section; wherein the LNG subcooler section is configured to further cool LNG received from the fourth processing section without use of a recirculated refrigerant; conduits through which the methane gas received from the source can flow into and out of the first, second, third and fourth processing sections and the LNG subcooler section; and a receptacle for LNG received from the LNG subcooler section.

According to another embodiment of the invention, a method is disclosed for removing nitrogen and for producing LNG from methane gas comprising other gaseous components, the method comprising: providing a source of methane gas disposed proximally to a processing site, the source being accessible to the site without transport through an external pipeline; and removing nitrogen from the methane gas and liquefying a substantial portion of the methane gas to produce LNG without use of a recirculated refrigerant.

According to another embodiment of the invention, a method is disclosed for producing LNG from methane gas containing other gaseous components, the method comprising: providing a source of methane gas disposed proximally to a processing site, the source being accessible to the site without transport through an external pipeline; introducing the methane gas into a first processing section configured to remove oxygen gas from the methane gas; introducing the methane gas into a second processing section configured to remove carbon dioxide from the methane gas; introducing the methane gas into a third processing section configured to dehydrate the methane gas; introducing the methane gas into a fourth processing section configured to remove nitrogen gas from the methane gas and to liquefy a substantial portion of the methane gas to produce LNG without use of a recirculated refrigerant; introducing the LNG received from the fourth processing station into an LNG subcooling section to further cool LNG received from the fourth processing section without use of a recirculated refrigerant; and introducing LNG received from the LNG subcooler section into a receptacle.

According to another embodiment of the invention, a system and method are disclosed for producing liquid nitrogen and LNG from methane as separate product streams without use of a recirculated refrigerant.

According to another embodiment of the invention, a system and method are disclosed for producing LNG from methane recovered from a coal mine or from an LNG loading station or facility.

According to another embodiment of the invention, a system and method are disclosed for producing LNG and liquid nitrogen from methane recovered from a coal mine or from an LNG loading station or facility, It will be appreciated by those of ordinary skill in the art upon reading this disclosure that additional processing sections for removing oxygen, carbon dioxide, water vapor, and possibly other components or contaminants that are present with methane in the inlet gas stream, can also be included in the system and method of the invention, depending upon factors such as, for example, the origin and intended disposition of the product streams and the amounts of such other gases or impurities or contaminants as are present in the inlet gas.

BRIEF DESCRIPTION OF THE DRAWINGS

The system and method of the invention are further described and explained in relation to the following drawings wherein.

DESCRIPTION OF THE PREFERRED EMBODIMENTS

Figure 1:
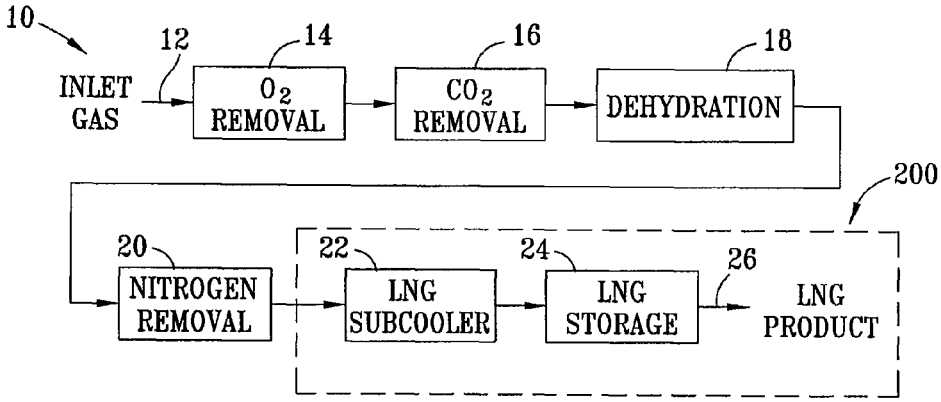
FIG. 1 is a simplified process flow diagram illustrating principal processing stages of one embodiment of a system and method for producing LNG from an inlet gas containing methane and other contaminants.

Referring to FIG. 1, one satisfactory system 10 of the invention comprises processing equipment useful for receiving methane gas and cooling it to form LNG without the use of external refrigeration or a recirculated refrigerant. Although the source of the methane gas is not critical to the system and method of the invention, some suitable sources of methane gas for use in the invention are coal mines, LNG loading facilities, and other industrial or geologic sources. The methane used as inlet gas stream 12 will typically contain other gases as well, with nitrogen, oxygen, carbon dioxide and water vapor being the most notable examples. Where present, it is generally preferable for purposes of the present invention to remove as much of the oxygen, carbon dioxide and water vapor as is reasonably possible prior to implementing the nitrogen removal and methane liquefaction portions of the invention. For this reason, system 10 of the invention as depicted in FIG. 1 includes first, second, third processing sections 14, 16, 18 for the removal of oxygen, carbon dioxide and water vapor, respectively, upstream of the nitrogen removal section 20 and the LNG subcooler section 22 and LNG storage 24 for the LNG product 26. Conventional technologies for removing oxygen and carbon dioxide from methane, and for dehydrating the methane stream to remove water vapor are generally well known and are already commercially available from various sources. For this reason, this disclosure is primarily directed to enabling those of ordinary skill in the art to produce LNG and, optionally, liquid nitrogen from a methane inlet stream without the need for external refrigeration (including cascade refrigeration or mixed refrigerant processes).

Figure 2:
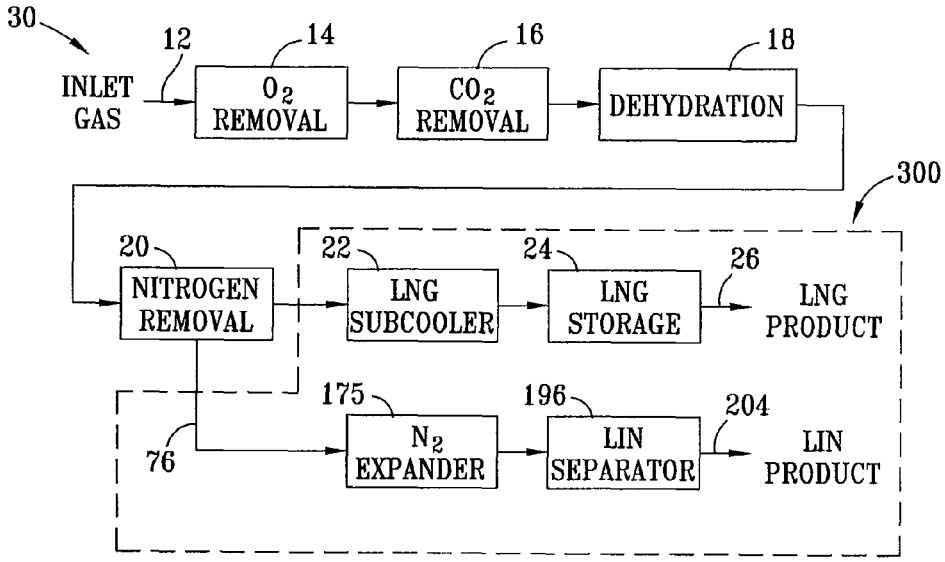
FIG. 2 is a simplified process flow diagram illustrating principal processing stages of another embodiment of a system and method for producing LNG and liquid nitrogen ("LIN") from an inlet gas containing methane and nitrogen.

Referring to FIG. 2, system 30 is disclosed as another suitable alternative embodiment of the invention. In this embodiment, the inlet gas 12, oxygen removal section 14, carbon dioxide removal section 16 and dehydration section 18 of the invention are provided as discussed above in relation to FIG. 1. In nitrogen removal section 20, however, a stream of nitrogen gas recovered from the methane is diverted to a nitrogen expander 175 to liquefy at least a portion of the stream, and then to a liquid nitrogen separator 196 to produce a liquid nitrogen product 204 in addition to LNG product 26 produced substantially as disclosed in relation to system 10 of FIG. 1.

Figure 3:
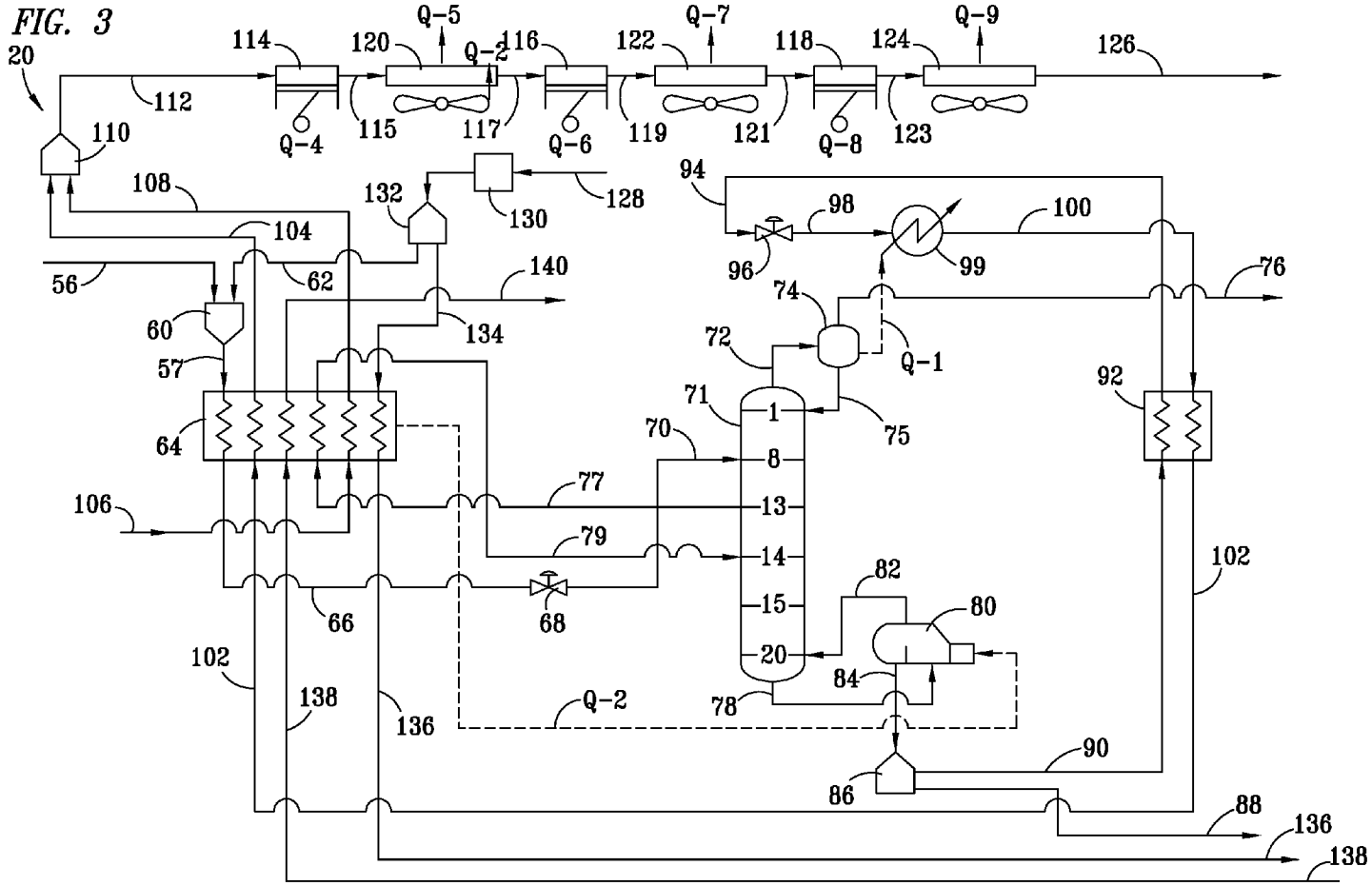
FIG. 3 is a more detailed process flow diagram illustrating one embodiment of the nitrogen removal section of the simplified process flow diagrams of FIGS. 1 and 2.

Nitrogen removal section 20 of the invention as seen in FIGS. 1 and 2 is further described and explained in relation to FIG. 3. Referring to FIG. 3, a nitrogen-containing methane feed stream 56 is combined in manifold 60 with recycled methane stream 62 from an expander-compressor section that is part of LNG subcooler section 22 and is further described below in relation to FIG. 4. Combined inlet stream 57 is directed to plate fin cooler 64 or another similarly suitable heat exchange device and emerges as stream 66. Stream 66 is controlled by valve 68 to produce stream 70 having substantially the same temperature but approximately half the pressure of stream 66 before entering nitrogen fractionation tower 71. Tower 71 operates at approximately −230° F. and 300 psia, and causes the nitrogen gas to separate from the methane and flow upwardly through the tower as a vapor.

Acceptable inlet compositions in which this invention may operate satisfactorily are listed in the following Table 1:

TABLE 1

INLET STREAM COMPOSITIONS

| Inlet Component | Acceptable Inlet Composition Ranges (Inlet Percent) |
|---|---|
| Methane | 20 to 100 |
| Oxygen | 0 to 15 |
| Carbon Dioxide | 0 to 5 |
| Nitrogen | 0 to 80 |

The flow rates, temperatures and pressures of various flow streams referred to in connection with the discussion of the system and method of the invention in relation to FIGS. 3 and 4 for a nominal inlet flow rate in this example of 19 MMSCFD appear in Table 2 below:

TABLE 2

FLOW STREAM PROPERTIES

| Stream Reference Numeral | Flow Rate (lbmol/h) | Temperature (deg. F.) | Pressure (psia) |
|---|---|---|---|
| 26 | 575 | −263 | 17 |
| 56 | 1617 | 121 | 640 |
| 57 | 1706 | 119 | 640 |
| 62 | 89 | 120 | 1033 |
| 66 | 1706 | −230 | 639 |
| 70 | 1706 | −231 | 315 |
| 72 | 1811 | −252 | 280 |
| 75 | 769 | −252 | 280 |
| 76 | 1043 | −252 | 280 |
| 76' | 1043 | −230 | 278 |
| 77 | 1769 | −224 | 280 |
| 78 | 1078 | −173 | 280 |

TABLE 2-continued

FLOW STREAM PROPERTIES

| Stream Reference Numeral | Flow Rate (lbmol/h) | Temperature (deg. F.) | Pressure (psia) |
|---|---|---|---|
| 79 | 1769 | −206 | 280 |
| 82 | 415 | −168 | 280 |
| 84 | 663 | −168 | 280 |
| 88 | 313 | −168 | 280 |
| 89 | 1043 | −308 | 30 |
| 90 | 350 | −168 | 280 |
| 94 | 350 | −250 | 278 |
| 98 | 350 | −250 | 30 |
| 100 | 350 | −257 | 16 |
| 102 | 350 | −235 | 14 |
| 104 | 350 | 110 | 14 |
| 106 | 1421 | −258 | 17 |
| 108 | 1421 | 105 | 16 |
| 112 | 1771 | 106 | 14 |
| 115 | 1771 | 363 | 55 |
| 117 | 1771 | 120 | 50 |
| 119 | 1771 | 313 | 140 |
| 121 | 1771 | 120 | 135 |
| 123 | 1774 | 325 | 400 |
| 126 | 1771 | 120 | 395 |
| 128 | 1771 | 120 | 1034 |
| 134 | 1683 | 120 | 1033 |
| 136 | 1683 | −12.5 | 1028 |
| 138 | 1043 | −225 | 28 |
| 140 | 1043 | 110 | 27 |
| 146 | 1771 | 120 | 635 |
| 152 | 1771 | 120 | 864 |
| 156 | 1771 | 158 | 1039 |
| 160 | 313 | −270 | 278 |
| 166 | 1683 | −200 | 125 |
| 169 | 8 | −200 | 124 |
| 170 | 1675 | −200 | 124 |
| 174 | 1675 | −253 | 20 |
| 178 | 1526 | −255 | 19 |
| 180 | 1526 | −258 | 17 |
| 184 | 105 | −258 | 17 |
| 186 | 156 | −255 | 19 |
| 188 | 575 | −263 | 17 |
| 192 | 0 | −263 | 17 |

Overhead nitrogen gas stream 72, shown as being external to tower 71 for purposes of illustration, is directed to condenser 74, but in practice condenser 74 is preferably a knockback condenser section that is internal to the tower, and is previously known. Condensate 75 is returned to the fractionation section of tower 71, and stream 76 of nitrogen gas is preferably directed to an $N_2$ expander that is further discussed below in relation to FIGS. 4 and 5. Q-1 represents the energy transferred to heat exchanger 99 from knockback condenser 74. Representative energy values for Q-1 and other energy streams that are identified in FIGS. 3 and 4 appear in Table 3 below:

TABLE 3

ENERGY STREAM REPORT

| Energy Stream Reference Numeral | Energy Rate (Btu/h) | From | To |
|---|---|---|---|
| Q-1 | 1.08E+06 | Virtual KB | KB Condenser |
| Q-2 | 1.05E+06 | Plate Fin | Virtual Reboiler |
| Q-4 | 4.26E+06 | | Sales 1st Stage |
| Q-5 | 4.07E+06 | 1st Sales Cooler | |

TABLE 3-continued

ENERGY STREAM REPORT

| Energy Stream Reference Numeral | Energy Rate (Btu/h) | From | To |
|---|---|---|---|
| Q-6 | 3.13E+06 | | Sales 2nd Stage |
| Q-7 | 3.20E+06 | 2nd Sales Cooler | |
| Q-8 | 3.31E+06 | | Sales 3rd Stage |
| Q-9 | 3.52E+06 | 3rd Sales Cooler | |
| Q-10 | 1.55E+06 | Warm Expander | Warm Comp |
| Q-11 | 965593 | Low Temp Exp | Low Temp Comp |
| Q-12 | 552059 | N2 Exp | Nitrogen Comp |
| Q-13 | 1.74E+06 | Warm Comp Cooler | |
| Q-14 | 1.14E+06 | LT Comp Cooler | |
| Q-15 | 679952 | N2 Comp Cooler | |

Stream 78 from the bottom of tower 71 is desirably directed to virtual reboiler 80 that receives heat (designated by energy stream Q-2) from plate fin cooler 64. Vapor stream 82 is returned to tower 71 and liquid methane stream 84 is directed through splitter manifold 86 to form two streams 88, 90 having comparable flow rates, temperatures and pressures. LNG stream 88 is directed to the LNG subcooling section 22 described below in relation to FIG. 4, and stream 90 is circulated through subcooler 92, valve 96 and heat exchanger 99, then back through subcooler 92 to plate fin cooler 64 as stream 102, through which it passes countercurrent to combined inlet stream 57. In this loop, the pressure of stream 90 is dropped more than about 260 psi and the stream is cooled more than 65 degrees before returning to plate fin cooler 64. In this manner, a portion of the LNG stream 84 produced in tower 71 can be recirculated for use an "internal" refrigerant for inlet stream 56. Sections of stream 90 are also designated by reference numerals 94, 98 and 100 at intermediate points between its passes through subcooler 92 to facilitate illustrating the temperature and pressure changes at various points in the loop.

Referring again to nitrogen fractionation tower 71, a sidestream 77 drawn, for example, from tray 13 of tower 71 is also directed back to and through plate fin cooler 64, again countercurrent to combined inlet stream 57, before returning as stream 79 to a lower position in tower 71, in this case tray 14. By reference to Table 2, it is seen that the temperature of the sidestream is increased by about 18° F. with virtually no change in pressure before reentering tower 71, thereby again serving as an "internal" refrigerant for inlet gas stream 56.

Stream 104 exits plate fin cooler 64 and is directed to mixing manifold 110 where it is desirably combined with stream 108 that emerges from plate fin cooler 64 after being returned as stream 106 from final LNG separator 182 of LNG subcooler section 22 as discussed below in relation to FIG. 4. Combined stream 112 is thereafter directed through an alternating series of compression stages 114, 116, 118 and sales coolers 120, 122, 124 in which the stream undergoes a net temperature increase of about 15 degrees and a net pressure increase of about 380 psi before flowing as stream 126 to a series of compression stages that are connected to and are driven by expanders, which extract mechanical energy from the expansion of gas streams that are further discussed below in relation to FIG. 4. Reference numerals 115, 117, 119, 121 and 123 are used to better illustrate the changes in temperature and pressure that the recycled material in stream 112 undergoes at intermediate points as it passes through the sales coolers before emerging as stream 126 in FIG. 3.

In summary, it is apparent from the foregoing discussion of nitrogen removal section 20 in relation to FIG. 3 and to the illustrative stream properties presented in Table 2 that substantial cooling of the inlet stream of mixed methane and nitrogen is achieved before reaching nitrogen fractionation tower 71 by strategically controlling the flows, temperatures and pressures of internal process streams and not through the use of external refrigeration.

Figure 4:
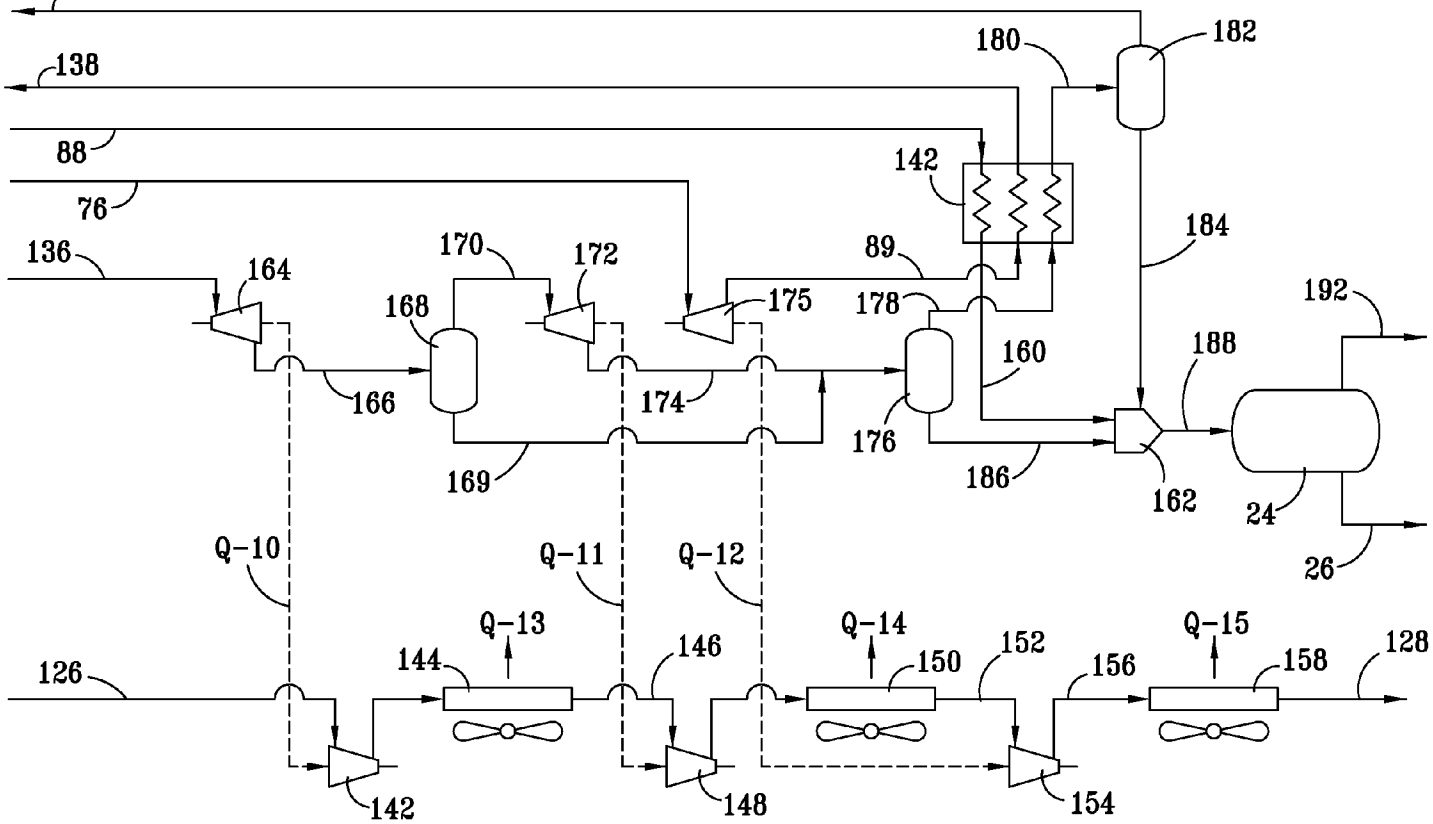
FIG. 4 is a more detailed process flow diagram illustrating one embodiment of the LNG production section of the simplified process flow diagrams of FIGS. 1 and 2.

Referring back to FIG. 1, the portion of system 10 that is inside dashed outline 200 is further described and explained in relation to FIG. 4. Referring to FIG. 4, stream 88 of LNG received from nitrogen removal section 20 of FIG. 3 is directed to subcooler 142, which is preferably a plate fin cooler or other similarly effective exchanger apparatus. The temperature of stream 88 is reduced approximately 100° F. with minimal pressure drop as it passes through subcooler 142, from which it emerges as stream 160 and is directed through manifold 162 into LNG storage section 24, from which LNG product 26 is produced. Referring to Table 2, LNG product can be produced according to the system and method of the invention at temperatures below 250° F. and pressures only slightly above atmospheric. LNG storage section 24 is desirably configured and adapted to recover any vapor that is flashed as stream 192. The substantial cooling provided by subcooler 142 to further lower the temperature of LNG received from nitrogen removal section 20 is again achieved through the use and control of internal process streams and not through use of external refrigeration.

One source of cooling within subcooler 142 is provided by expanding the gaseous nitrogen received from nitrogen removal section 20 in stream 76. Stream 76 is desirably directed to $N_2$ expander 175, from which it exits as stream 89, which is then directed to subcooler 142 countercurrent to the incoming flow of LNG in stream 88. Inside $N_2$ expander 175, the stream pressure is reduced by about 250 psi, with an attendant temperature reduction of about 55° F., to below −300° F. After emerging from subcooler 142, nitrogen stream 138 is returned to plate fin cooler 64 countercurrent to combined inlet stream 57 as described above, after which it exits as vent stream 140.

Another source of cooling within subcooler 142 is provided by sequentially expanding high pressure stream 136, which passes sequentially through warm expander 164, low temperature expander scrubber 168, low temperature expander 172, and LNG separator 176. In LNG separator 176, the material from stream 136 separates into streams 178, 186, respectively, with the flow rate of stream 178 being substantially greater (by a factor of about 10) than the flow rate of stream 186. During the progression from stream 136 to stream 178, the temperature drops about 240° as the pressure drops more than 1000 psi. Reference numerals 166, 170 and 174 are used to designate stream 136 at intermediate points between warm expander 164 and LNG separator 176 to assist in identifying the temperatures and pressures of the steam at those points.

As stream 178 passes through subcooler 142, it cools slightly more and exits as stream 180 into final LNG separator 182. In LNG separator 182, the material from stream 180 separates into streams 106 and 184, respectively, with the flow rate of stream 106 again being substantially greater than the flow rate of stream 184. Stream 106 is directed back to nitrogen removal section 20 of FIG. 3, where it enters and passes through plate fin cooler 64, from which it exits as stream 108 that is combined with stream 104 in manifold 110 to produce stream 112 as discussed above in relation to FIG. 3. Referring again to FIG. 4, stream 186 from LNG separator 176 and stream 184 from final LNG separator 182 are then combined in manifold 162 to form combined stream 188 that flows into LNG storage tank 24, from which LNG product 26 is produced.

Stream 136 as described above is received by warm expander 164 from plate fin cooler 64 in nitrogen removal section 20 of FIG. 3, which enters plate fin cooler 64 as stream 134. Stream 134 is formed when stream 128 as shown in FIG. 3 is split into streams 62 and 134 in manifold 132, after which stream 62 is combined with inlet stream 56 in manifold 60. Stream 128, in turn, originates from stream 126 of FIG. 3, after passing through a loop that is further described and explained in relation to LNG subcooler section 22 in FIG. 4.

Referring again to FIG. 4, stream 126 is received from nitrogen removal section 20 and passes successively through warm compressor 142, warm compressor cooler 144, low temperature compressor 148, low temperature compressor cooler 150, nitrogen compressor 154 and $N_2$ compressor cooler 158, before returning to nitrogen removal section 20 as stream 182, discussed above. Intermediate stream designations 146, 150, 152 and 156 are provided for use in tracking relative temperatures and pressures through this portion of system 10 of the invention. As compared to stream 126, the temperature of stream 128 is increased by less than 50° F. but the pressure is increased by more than 600 psi. Illustrative energy streams corresponding to the movement of the material of stream 126 through the various devices as identified above between stream 126 and stream 128 are reported in Table 2. All devices identified in relation to FIGS. 3 and 4 are believed to be commercially available from sources known to those of ordinary skill in the art, and particular equipment specifications will depend upon factors that can vary, for example, according to the intended application, use site, inlet gas composition, throughputs and operating conditions.

Figure 5:
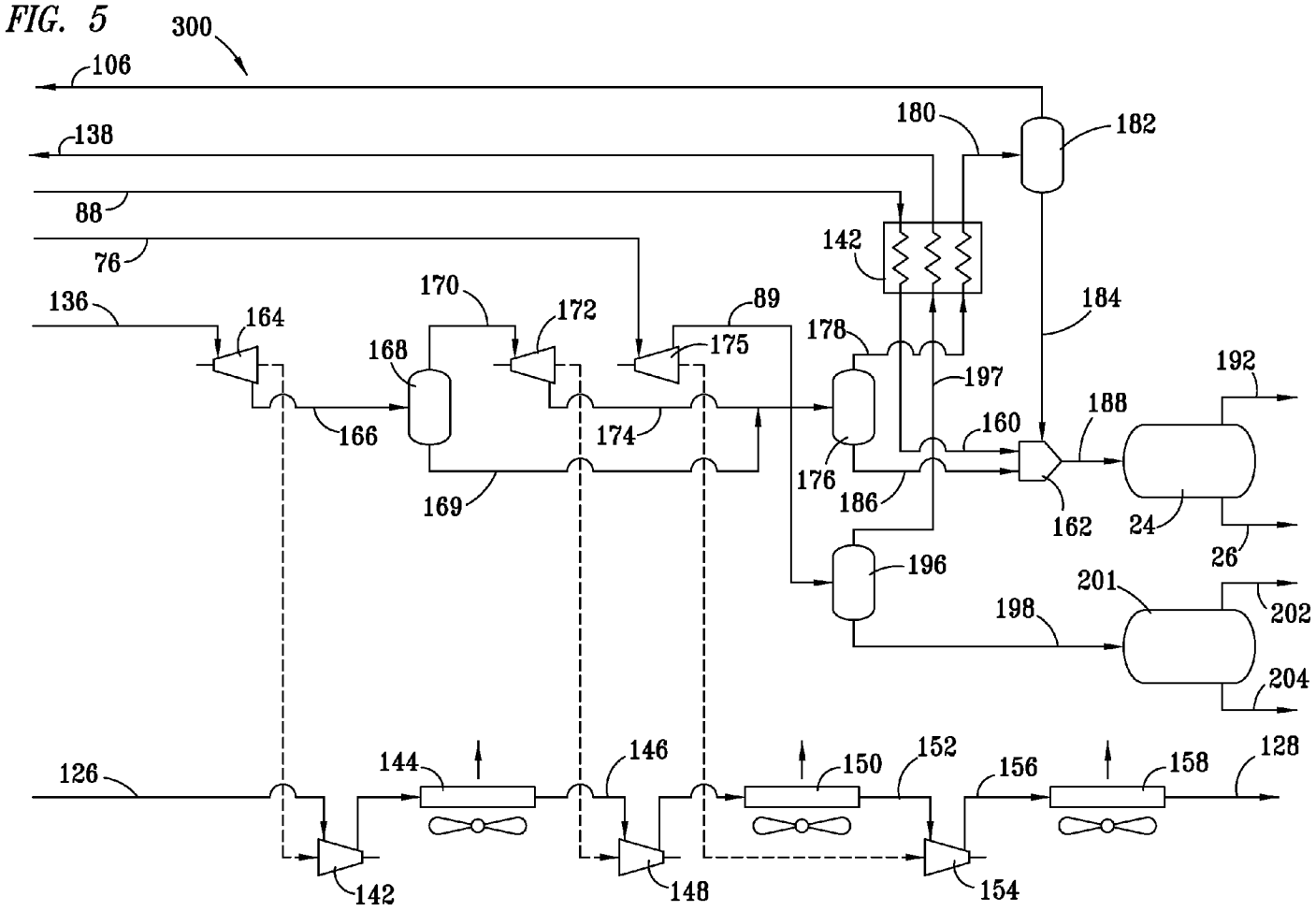
FIG. 5 is a modified version of the detailed process flow diagram of FIG. 4 illustrating an alternate embodiment in which a liquid nitrogen stream is produced as another byproduct of the system and method of the invention.

In accordance with another alternative embodiment of the invention in which liquid nitrogen is also produced according to the system and method of the invention, which corresponds to that portion of FIG. 2 that is identified by dashed box 300 and which is further described and explained in relation to FIG. 5, stream 89 can be directed to liquid nitrogen separator 196, from which overhead stream 197 is returned to subcooler 142. Stream 197 enters subcooler 142 countercurrent to LNG stream 88 in substantially the same manner that stream 89 did in the embodiment described in relation to FIG. 4, and exits as stream 138. Stream 138 is then returned to plate fin cooler 64 in nitrogen removal section 20, as previously shown and described in relation to FIG. 3. Liquid nitrogen stream 198, which exits from the bottom of liquid nitrogen separator 196, is desirably directed to storage vessel 201, from which liquid nitrogen product stream 204 is produced, with any flashed nitrogen vapor exiting vessel 201 as vent stream 202.

It should be appreciated by those of ordinary skill in the art upon reading this disclosure that the flow rate, temperature and pressure of stream 138 as shown in FIG. 5 will differ somewhat from the values as reported in Table 2 for the embodiment described in relation to FIGS. 3 and 4, which can in turn have a slight effect on the temperatures, pressures and/or energy values for other streams reported in Tables 2 and 3 to the extent that those streams are also referred to in the alternative embodiment of FIG. 5. Otherwise, the streams and flow configurations previously described in relation to FIGS. 3 and 4 are likewise applicable to like-numbered streams in FIG. 5.

Other alterations and modifications of the invention will likewise become apparent to those of ordinary skill in the art upon reading this specification in view of the accompanying drawings, and it is intended that the scope of the invention disclosed herein be limited only by the broadest interpretation of the appended claims to which the inventor is legally entitled.

I claim:

1. A system for removing nitrogen and for producing liquefied natural gas (LNG) from methane gas comprising other gaseous components, the system comprising:

a source of methane gas disposed proximally to a processing site, the source being accessible to the site without transport through an external pipeline;

a nitrogen removal section configured to remove nitrogen gas from the methane gas and to liquefy a substantial portion of the methane gas to produce LNG without use of a recirculated refrigerant, wherein the nitrogen removal section comprises a plate fin cooler and a nitrogen fractionation tower;

wherein the nitrogen fractionation tower discharges gaseous nitrogen and LNG;

wherein the gaseous nitrogen is expanded and cooled;

wherein the expanded and cooled nitrogen is used to subcool the LNG;

wherein the nitrogen used to subcool the LNG is recirculated to the plate fin cooler;

wherein the recirculated nitrogen cools the methane gas;

wherein the recirculated nitrogen is vented after cooling the methane gas;

an LNG subcooler section comprising at least one separator wherein cold but unliquefied methane gas is separated from the LNG and is recirculated to the plate fin cooler in the nitrogen removal section, wherein the recirculated methane gas cools the methane gas entering the nitrogen removal section;

at least one compressor that compresses the recirculated methane gas exiting the plate fin cooler, which compressed recirculated methane gas is then recycled, and apparatus that splits the recycled compressed recirculated methane gas into a first part and a second part;

a receptacle for LNG received from the LNG subcooler section;

apparatus for combining the first part with the methane gas entering the nitrogen removal section upstream of the plate fin cooler and upstream of the nitrogen fractionation tower; and a conduit through which the second part flows through the plate fin cooler and then into the LNG subcooler section, where the second part is received into at least one expander and cooled sufficiently to liquefy at least a portion thereof.

2. The system of claim 1 comprising apparatus for combining the liquefied portion with the LNG received into the receptacle.

3. A method for removing nitrogen and for producing liquefied natural gas (LNG) from methane gas comprising other gaseous components, the method comprising:

providing a source of methane gas disposed proximally to a processing site, the source being accessible to the site without transport through an external pipeline;

removing nitrogen from the methane gas and liquefying a substantial portion of the methane gas to produce LNG without use of a recirculated refrigerant and wherein the nitrogen is removed in a nitrogen removal section comprising a nitrogen fractionation tower and a plate fin cooler;

subcooling the LNG without use of a recirculated refrigerant in an LNG subcooler section, wherein the LNG subcooler section comprises at least one separator wherein cold but unliquefied methane gas is separated from the LNG and is recirculated to the plate fin cooler in the nitrogen removal section, wherein the recirculated methane gas cools the methane gas entering the nitrogen removal section;

compressing the recirculated methane gas exiting the plate fin cooler, recycling the compressed recirculated methane gas, and splitting the recycled compressed recirculated methane gas into first part and a second part;

combining the first part with the methane gas introduced into the nitrogen removal section upstream of the plate fin cooler and upstream of the nitrogen fractionation tower; and directing a flow of the second part through the plate fin cooler and then into the LNG subcooler section, and thereafter expanding and cooling the flow sufficiently to liquefy at least a portion thereof.

4. The method of claim 3 comprising combining the liquefied portion with the subcooled LNG and introducing the subcooled LNG into a receptacle.

5. A system for producing liquefied natural gas (LNG) from methane gas comprising other gaseous components, the system comprising:

a source of methane gas disposed proximally to a processing site, the source being accessible to the site without transport through an external pipeline;

a first processing section configured to remove oxygen gas from the methane gas;

a second processing section configured to remove carbon dioxide from the methane gas;

a third processing section configured to dehydrate the methane gas;

a fourth processing section configured to remove nitrogen gas from the methane gas and to liquefy a substantial portion of the methane gas to produce LNG without use of a recirculated refrigerant and comprising a nitrogen fractionation tower and a plate fin cooler;

an LNG subcooler section disposed downstream of the fourth processing section; wherein the LNG subcooler section is configured to further cool LNG received from the fourth processing section without use of a recirculated refrigerant and comprises at least one separator wherein cold but unliquefied methane gas is separated from the LNG and is recirculated to the plate fin cooler in the fourth processing section, wherein the recirculated methane gas cools the methane gas entering the fourth processing section;

conduits through which the methane gas received from the source can flow into and out of the first, second, third and fourth processing sections and the LNG subcooler section;

a receptacle for LNG received from the LNG subcooler section;

at least one compressor that compresses the recirculated methane gas exiting the plate fin cooler, which compressed recirculated methane gas is then recycled, and apparatus that splits the recycled compressed recirculated methane gas into a first part and a second part;

apparatus for combining the first part with the methane gas entering the fourth processing section upstream of the plate fin cooler and upstream of the nitrogen fractionation tower; and additional conduit through which the second part flows through the plate fin cooler and then into the LNG subcooler section, where the second part is received into at least one expander and cooled sufficiently to liquefy at least a portion thereof.

6. The system of claim 5 comprising apparatus for combining the liquefied portion with the LNG received into the receptacle.

7. A method for producing liquefied natural gas (LNG) from methane gas containing other gaseous components, the method comprising:

providing a source of methane gas disposed proximally to a processing site, the source being accessible to the site without transport through an external pipeline;

introducing the methane gas into a first processing section configured to remove oxygen gas from the methane gas;

introducing the methane gas into a second processing section configured to remove carbon dioxide from the methane gas;

introducing the methane gas into a third processing section configured to dehydrate the methane gas;

introducing the methane gas into a fourth processing section configured to remove nitrogen gas from the methane gas and to liquefy a substantial portion of the methane gas to produce LNG without use of a recirculated refrigerant, the fourth processing section comprising a nitrogen fractionation tower and a plate fin cooler;

introducing the LNG received from the fourth processing station into an LNG subcooling section to further cool LNG received from the fourth processing section without use of a recirculated refrigerant, the LNG subcooling section comprising at least one separator wherein cold but unliquefied methane gas is separated from the LNG and is recirculated to the plate fin cooler in the fourth processing section, wherein the recirculated methane gas cools the methane gas entering the fourth processing section;

introducing LNG received from the LNG subcooler section into a receptacle;

compressing the recirculated methane gas exiting the plate fin cooler;

recycling the compressed recirculated methane gas;

splitting the recycled compressed recirculated methane gas into a first part and a second part;

combining the first part with the methane gas introduced into the fourth processing section upstream of the plate fin cooler and upstream of the nitrogen fractionation tower; and directing a flow of the second part through the plate fin cooler and then into the LNG subcooler section, and thereafter expanding and cooling the flow sufficiently to liquefy at least a portion thereof.

8. The method of claim 7 comprising combining the liquefied portion with the LNG introduced into the receptacle.

* * * * *